US007439428B1

(12) United States Patent
Nagahara

(10) Patent No.: US 7,439,428 B1
(45) Date of Patent: Oct. 21, 2008

(54) WIND INSTRUMENTS

(76) Inventor: Kanichi Nagahara, 32 Wild Rose Dr., Andover, MA (US) 01810

( * ) Notice: Subject to any disclaimer, the term of this patent is extended or adjusted under 35 U.S.C. 154(b) by 0 days.

(21) Appl. No.: 11/821,529

(22) Filed: Jun. 25, 2007

(51) Int. Cl.
*G10D 7/00* (2006.01)

(52) U.S. Cl. ..... 84/380 R

(58) Field of Classification Search ..... 84/380 R, 84/381, 382, 385 R, 385 A, 387 R
See application file for complete search history.

(56) References Cited

U.S. PATENT DOCUMENTS 5,780,757 A * 7/1998 Valtchev et al. ..... 84/380 R
5,796,022 A * 8/1998 Miller ..... 84/380 R

* cited by examiner

*Primary Examiner*—Kimberly R Lockett
(74) *Attorney, Agent, or Firm*—Lambert & Associates; Gary E. Lambert

(57) ABSTRACT

An improved wind instrument incorporating several innovative design features that collectively enhance the sound and playability of a wind instrument including a footjoint section in which low B is normally closed and is opened only when low C is sounded. Additional improvements include the tone of the instrument in the third octave, especially high G#, high F# high B and high C and the introduction of a low B key that does not have to be pressed for notes in the third octave. Finally, a wind instrument with a tapered bore in the body combined with a tapered bore in the headjoint to improve the intonation match between octaves even more than is possible with a tapered headjoint alone.

45 Claims, 6 Drawing Sheets

WIND INSTRUMENTS

FIELD OF THE INVENTION

This invention relates to musical instruments. More particularly, this invention relates to improved flutes and piccolos having an improved body, keys and keys capable of attaining a better intonation and more dynamic range.

BACKGROUND OF THE INVENTION

There exist flutes, piccolos and generally wind instruments which possess a footjoint section which allows the instrument to play notes down to low B. Traditionally all of the footjoint keys are open with the exception of D#. And traditionally the low B key is closed only when playing low B and when playing C in the third octave.

Prior to Theobald Boehm, (Apr. 9, 1794-Nov. 25, 1881) the Bavarian inventor and musician, who perfected the modern flute and its improved fingering system, most flutes and piccolos had a tapered bore and included a small diameter of the taper at the foot of the instrument. This taper solved intonation problems associated with notes in the upper registers. Boehm changed this bore design and placed the taper at the headjoint end with the small diameter of the taper at the crown and additionally utilized a straight bore for the body. As such, the larger body improved projection and tone quality while the tapered headjoint simultaneously corrected intonation problems seen in earlier flutes. This basic layout has remained unchanged in modern flutes and some piccolos since Boehm's time.

Today, two genres of flute and piccolo bore designs exist in the art. The first category, found in some piccolos and most modern flutes, features a straight body and tapered headjoint. The second variety, found in most modern piccolos and all Baroque flutes, features a tapered body and straight bore headjoint.

What is needed is a footjoint section in which low B is normally closed and is opened only when low C is sounded. This improves the tone of the piccolo or flute in the third octave, especially high G#, high F# high B and high C. It makes playing the instrument easier because the low B key does not have to be pressed for notes in the third octave.

What is also needed is a flute or piccolo with a tapered bore in the body combined with a tapered bore in the headjoint to improve the intonation match between octaves even more than is possible with a tapered headjoint alone.

SUMMARY OF THE INVENTION

It is an object of the instant invention, in one embodiment, by way of example only, to provide a footjoint section in which low B is normally closed and is opened only when low C is sounded. It is an object of the instant invention, in one embodiment, by way of example only, to provide improvements to the tone of the piccolo or flute in the third octave, especially high G#, high F# high B & high C.

It is an object of the instant invention, in one embodiment, by way of example only, to make playing the instrument easier as the low B key does not have to be pressed for notes in the third octave.

It is an object of the instant invention, in one embodiment, by way of example only to provide a flute or piccolo with a tapered bore in the body combined with a tapered bore in the headjoint to improve the intonation match between octaves even more than is possible with a tapered headjoint alone.

Accordingly, an improved flute or piccolo and accompanying enhancements its component elements are herein described, which achieve these objectives, plus other advantages and enhancements. These improvements to the art will be apparent from the following description of the invention when considered in conjunction with the accompanying drawings wherein there has thus been outlined, rather broadly, the more important features of the improved flute or piccolo in order that the detailed description thereof that follows may be better understood, and in order that the present contribution to the art may be better appreciated.

There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

DETAILED DESCRIPTION OF THE SEVERAL AND PREFERRED EMBODIMENTS

The detailed description set forth below in connection with the appended drawings is intended as a description of presently-preferred embodiments of the invention and does not represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention, such as numerous wind instruments.

Figure 1:
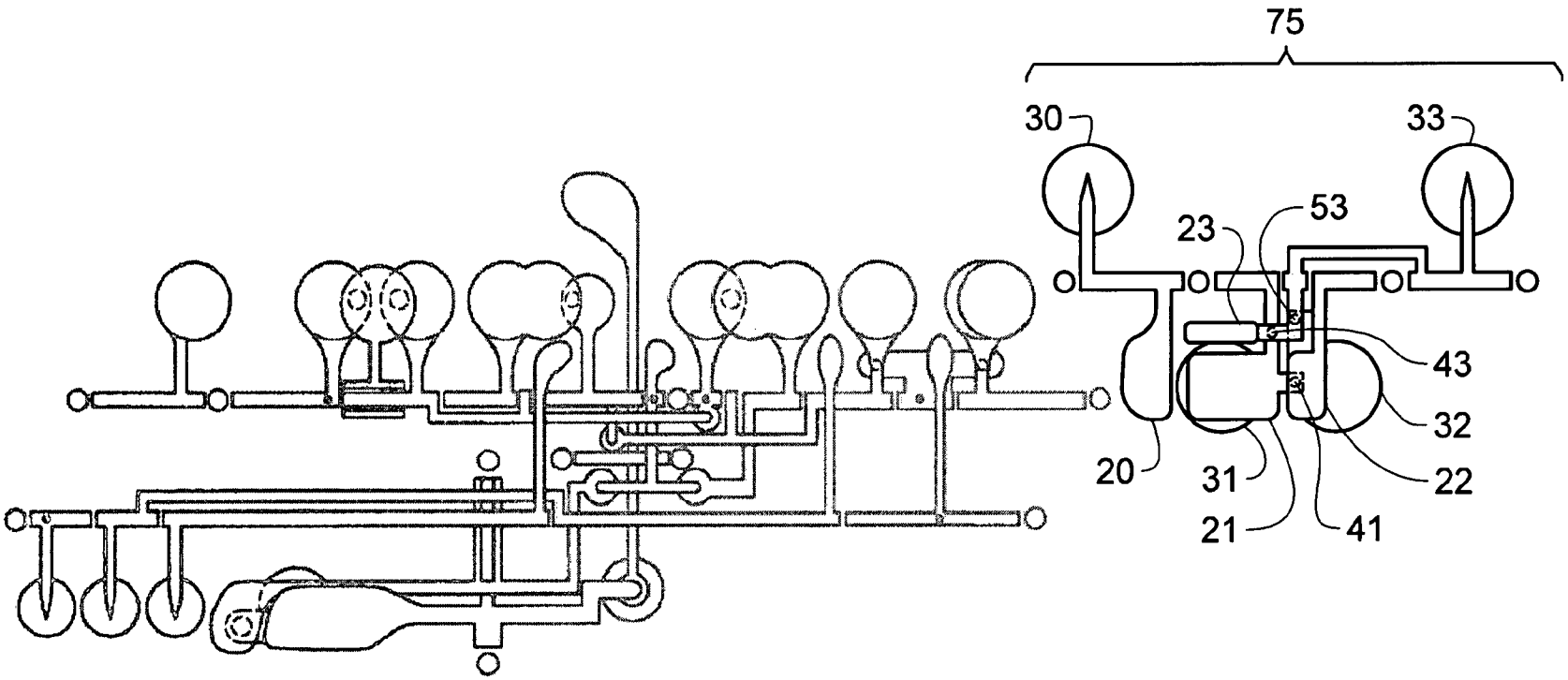
FIG. 1 is a plan view looking down on the present invention and illustrates the keys of a piccolo with special emphasis on the footjoint section of the instrument.

FIG. 1 depicts the one embodiment of the novel footjoint section 75 for an improved flute, piccolo or other wind instrument, and the relationship of the footjoint section 75 to the other keys of the instrument. Illustrated is a first tone hole cup or first cup 30 disposed to cover the D# tone hole and said first cup 30 is maintained in a normally closed position by use of a spring mechanism as known in the art. The first cup 30 is further connected to a first key 20 such that low D# may be played by pressing first key 20. Additionally illustrated, a second tone hole cup or second cup 33 covers the low B tone hole and is also maintained in a normally closed position by a spring mechanism as known in the art.

Figure 2:
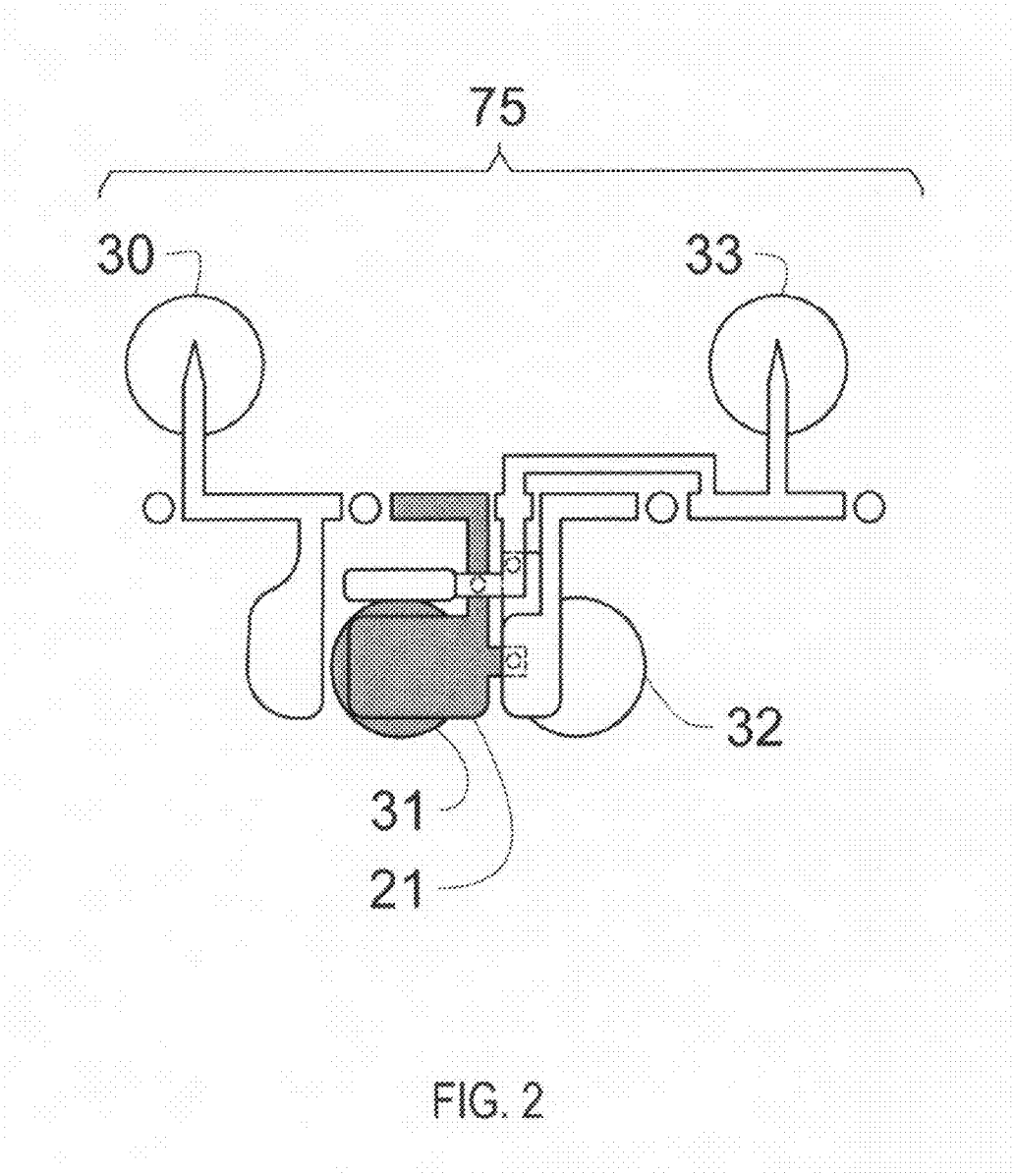
FIG. 2 is a plan view looking down on the present invention and depicts a preferred embodiment of the footjoint and highlights the mechanism used for playing low C#.

FIG. 2 depicts a further embodiment of the footjoint section 75 and the keys and cups used in playing low C#. As stated above, first cup 30 is normally closed. First cup 30 is thus disposed for low D# and must be closed when any note lower than low D# is played. Additionally, the footjoint section 75 may comprise a second key 21 affixed directly above a third tone hole cup or third cup 31 such that when pressed, the second key 21 closes the third cup 31. Fourth tone hole cup or fourth cup 32 is normally open and is closed whenever low C or low B is played. Second cup 33 is normally closed and is opened only for low C.

Figure 3:
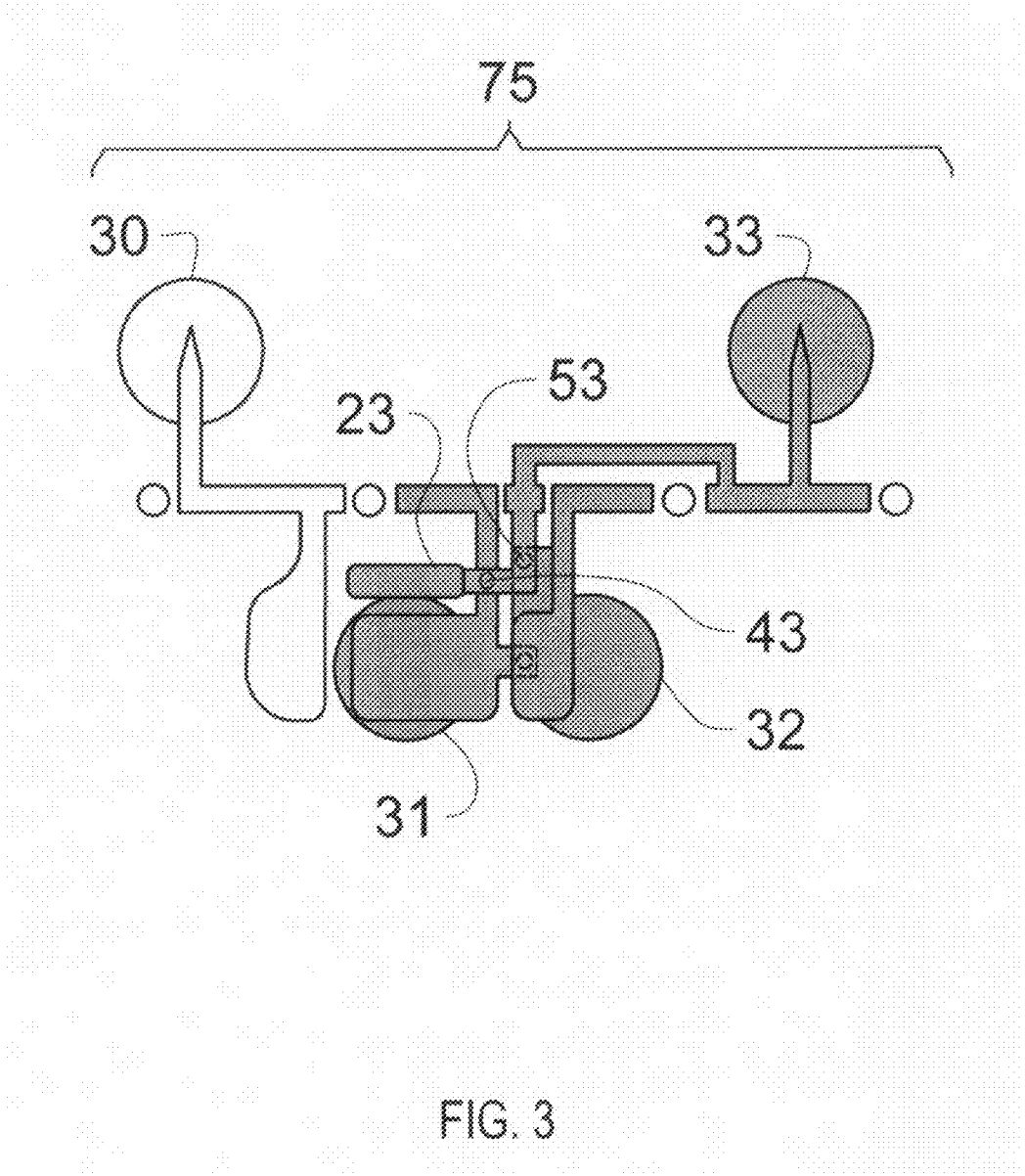
FIG. 3 is a plan view looking down on the present invention and depicts a preferred embodiment of the footjoint and highlights the mechanism used for playing low C.

FIG. 3 depicts a further embodiment of footjoint section 75 and highlights the mechanism for playing low C. As stated above, first cup 30 is disposed for low D# and must be closed when any note lower than low D# is played. When third key 23, a roller key is pressed, first contact point 43 causes third cup 31 to close and second contact point 53 causes fourth cup 32 close. Finally here, second cup 33, which is normally closed, opens because it is connected to third key 23.

Figure 4:
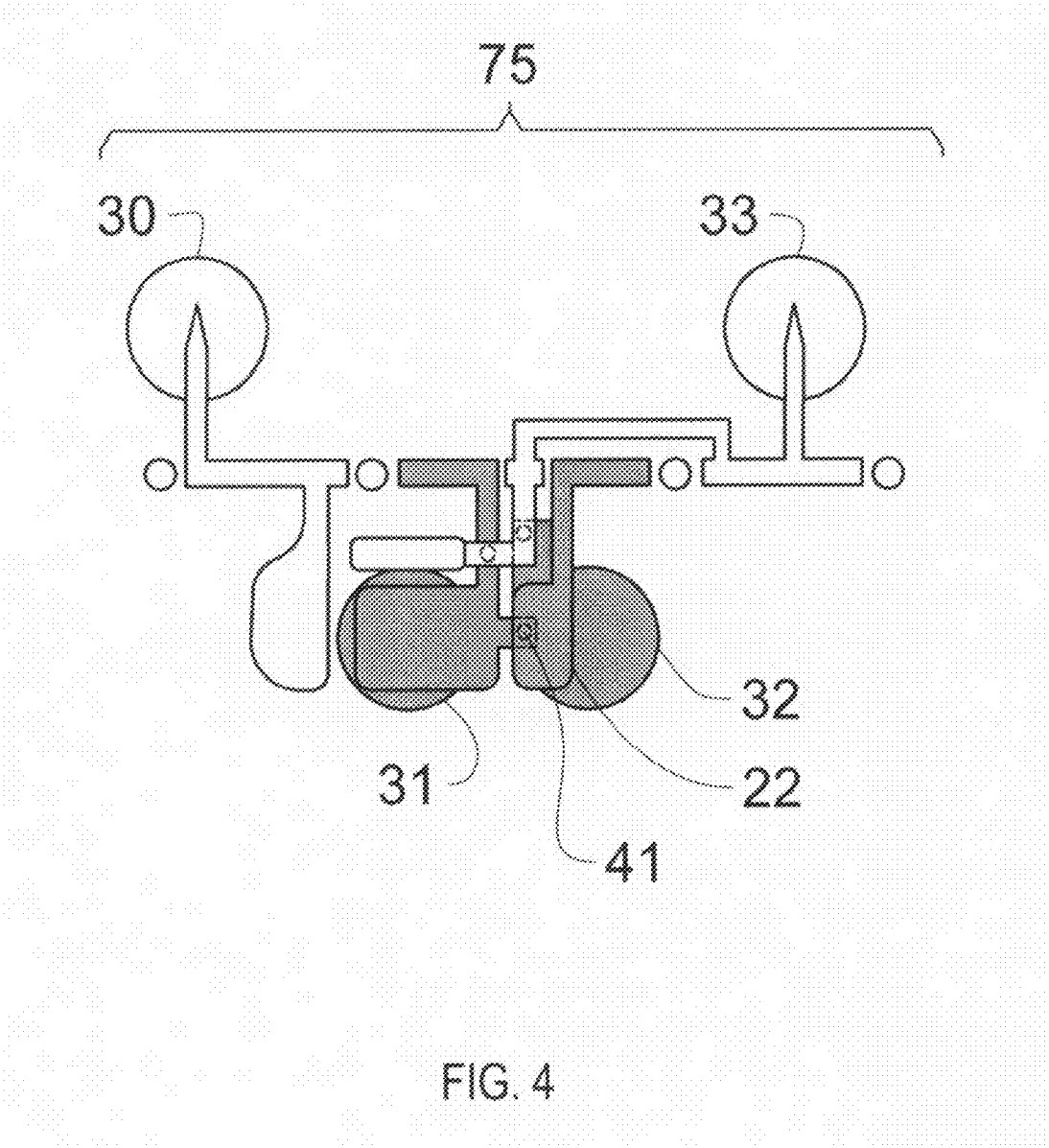
FIG. 4 is a plan view looking down on the present invention and depicts a preferred embodiment of the footjoint and highlights the mechanism used for playing low B.

FIG. 4 depicts an additional embodiment of footjoint section 75 and highlights the mechanism for playing low B. Once again, first cup 30 is for low D# and must be closed when any note lower than low D# is played. When fourth key 22 is closed, third contact point 41 closes third cup 31 and fourth cup 32 closes because it is attached to the fourth key 22. In this configuration, second cup 33, which is normally closed, remains closed.

Figure 5:
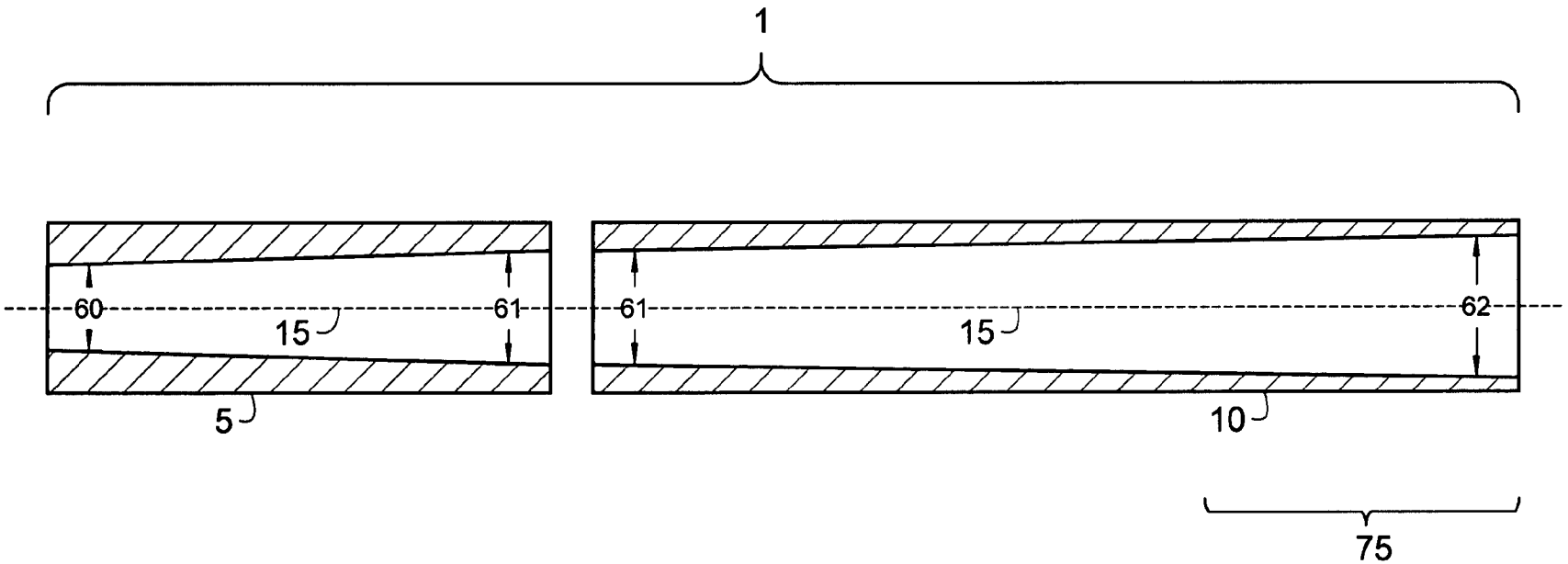
FIG. 5 is a cross-sectional view depicting the headjoint tapered bore and the body section with a tapered bore though the entire body.

In an additional embodiment, FIG. 5 depicts a design for a bore through a headjoint section 5 and a body section 10 of a flute or piccolo 1 in accordance with the first variation of the present invention. As clearly shown, the bore though the headjoint section 5 of piccolo 1 is centered about the longitudinal axis 15 of flute or piccolo 1 and extends throughout the entire length of headjoint section 5.

Furthermore, the bore through the body section 10 of flute or piccolo 1 is tapered along the entire length. Headjoint section 5 has a similar diameter to body section 10 where the two parts connect at dimension 61 and is smaller at dimension 60. The bore though the body section 10 of piccolo 1 is centered about the longitudinal axis 15 of flute or piccolo 1 and extends throughout the entire length of body section 10. Furthermore, the bore through the body section 10 of flute or piccolo 1 is tapered. Body section 10 has a similar diameter to headjoint section 5 at dimension 61 and is larger at dimension 62.

Thus, in one embodiment, the improved wind instrument may comprise the following: a body section having a cylindrical bore therethrough wherein said cylindrical bore is centered about and coincident with a longitudinal axis of said instrument and wherein said cylindrical bore is tapered along an entire length of said body section from a first end to a second end and wherein the diameter of said first end of said cylindrical bore is larger than the diameter of said second end of said cylindrical bore;

This embodiment will further comprise a headjoint section having a cylindrical bore therethrough, wherein said cylindrical bore is centered about and coincident with the longitudinal axis of said instrument, wherein said first end of said headjoint section mates with said second end of said body section and wherein said first end of said headjoint section comprises a diameter substantially equal to said diameter of said cylindrical bore of said second end of said body section and wherein said diameter of said cylindrical bore of said headjoint section is tapered along an entire length of said headjoint section from said first end to a second end and wherein the diameter of said first end of said cylindrical bore is larger than the diameter of said second end of said cylindrical bore.

This embodiment will further comprise a footjoint having a cylindrical bore therethrough, wherein said cylindrical bore is centered about and coincident with the longitudinal axis of said instrument and wherein a second end of said footjoint section mates with said first end of said body section and wherein said second end of said footjoint section comprises a diameter substantially equal to said diameter of said cylindrical bore of said first end of said body section and wherein said diameter of said cylindrical bore of said footjoint section is tapered along an entire length of said footjoint section from said first end to said second end wherein said diameter of said first end of said cylindrical bore is larger than said diameter of said second end of said cylindrical bore.

Figure 6:
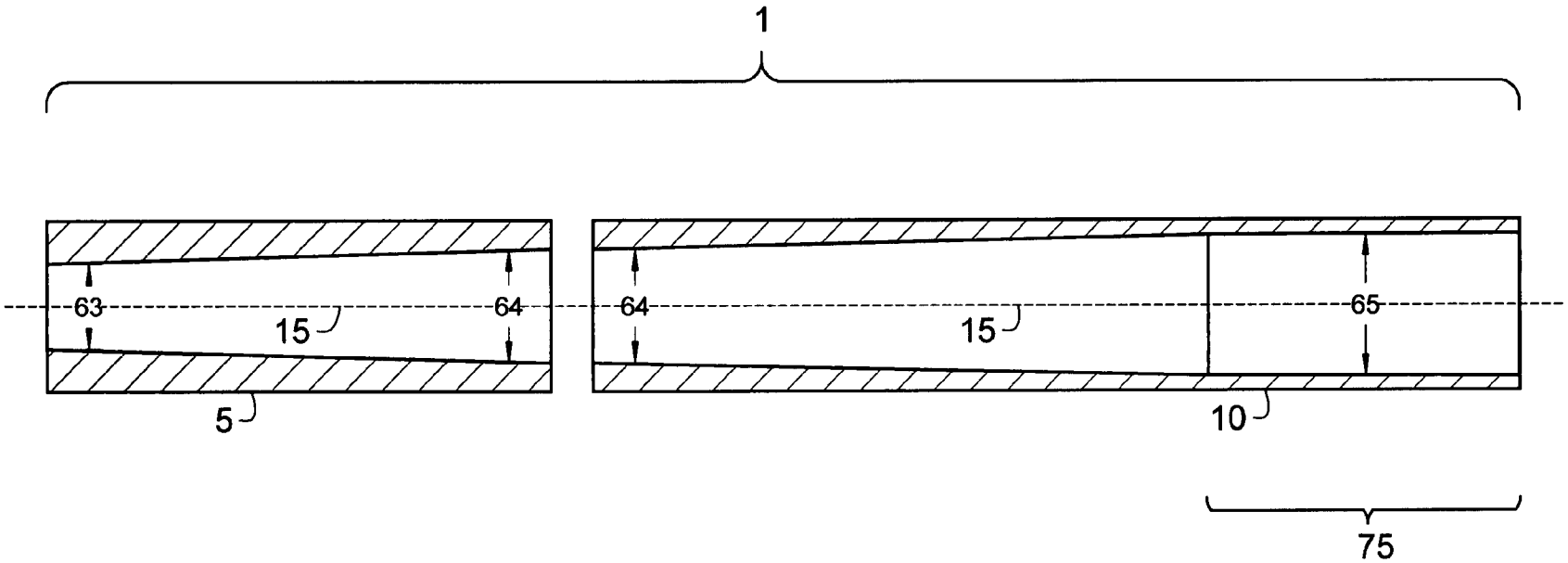
FIG. 6 is a cross-sectional view depicting the headjoint tapered bore and the body section tapered bore with a straight bore at the footjoint section.

In a further embodiment, FIG. 6 depicts the preferred embodiment for a bore through a headjoint section 5 and a body section 10 of a flute or piccolo 1 in accordance with the second variation of the present invention. As clearly shown, the bore though the headjoint section 5 of piccolo 1 is centered about the longitudinal axis 15 of flute or piccolo 1 and extends throughout the entire length of headjoint section 5. Furthermore, the bore through the body section 10 of flute or piccolo 1 is tapered to the footjoint section. Headjoint section 5 has a similar diameter to body section 10 where the two parts connect at dimension 64 and is smaller at dimension 63. The bore though the body section 10 of piccolo 1 is centered about the longitudinal axis 15 of flute or piccolo 1 and extends throughout the entire length of body section 10. Furthermore, the bore through the body section 10 of flute or piccolo 1 is tapered to the footjoint section 75 and cylindrical for the length of the footjoint section. Body section 10 has a similar diameter to headjoint section 5 at dimension 64 and is larger at dimension 65.

Thus, in one embodiment, the improved wind instrument may comprise the following: a body section having a cylindrical bore therethrough wherein said cylindrical bore is centered about and coincident with a longitudinal axis of said instrument and wherein said cylindrical bore is tapered along an entire length of said body section from a first end to a second end and wherein the diameter of said first end of said cylindrical bore is larger than the diameter of said second end of said cylindrical bore.

This embodiment will further comprise a headjoint section having a cylindrical bore therethrough, wherein said cylindrical bore is centered about and coincident with the longitudinal axis of said instrument, wherein said first end of said headjoint section mates with said second end of said body section and wherein said first end of said headjoint section comprises a diameter substantially equal to said diameter of said cylindrical bore of said second end of said body section and wherein said diameter of said cylindrical bore of said headjoint section is tapered along an entire length of said headjoint section from said first end to a second end and wherein the diameter of said first end of said cylindrical bore is larger than the diameter of said second end of said cylindrical bore.

This embodiment will further comprise a footjoint section having a cylindrical bore therethrough, wherein said cylindrical bore is centered about and coincident with said longitudinal axis of said instrument wherein said diameter of said cylindrical bore is uniform throughout the entirety of said footjoint section and wherein said diameter is substantially equal to the diameter and wherein said body section mates with said footjoint section at an end of said body section opposing said end which mates with said headjoint section.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

The invention claimed is:

1. An improved wind instrument comprising:

a body section having a cylindrical bore therethrough wherein the cylindrical bore through said body section is centered about and coincident with a longitudinal axis of the piccolo and uniform in diameter throughout the entirety of said body section;

a headjoint having a conical bore therethrough wherein said conical bore through said headjoint is centered about and coincident with said longitudinal axis of said instrument and wherein said bore substantially tapers from a diameter equal to the diameter of said cylindrical bore of said body section, at a point where said headjoint mates with said body section, to a diameter less than the diameter of said cylindrical bore of said body section at an opposing end of said headjoint, and wherein said longitudinal axis of said headjoint and said longitudinal axis of said body section are aligned and engaged; and, a footjoint section having a cylindrical bore therethrough wherein said cylindrical bore is centered about and coincident with said longitudinal axis of said instrument and uniform in diameter throughout the entirety of said footjoint section and wherein said body section mates with said footjoint section at an end of said body section opposing said end which mates with said headjoint section and wherein said longitudinal axis of said footjoint section is aligned with said longitudinal axis of said headjoint and said longitudinal axis of said body section and wherein said footjoint section is disposed such that during normal play of said improved piccolo, a low B key is normally closed and is opened only when low C is sounded.

2. The improved wind instrument of claim 1 wherein said a footjoint section further comprises a first tone hole cup disposed to cover a D# tone hole, said first tone hole cup disposed to be normally closed by use of a spring mechanism.

3. The improved wind instrument of claim 2 wherein said first tone hole cup is further connected to a first key.

4. The improved wind instrument of claim 3 wherein a low D# may be played by pressing said first key.

5. The improved wind instrument of claim 2 wherein said first tone hole cup is closed when any note lower than low D# is played.

6. The improved wind instrument of claim 5 wherein said footjoint section is utilized to play a low C# wherein said first tone hole cup is normally closed.

7. The improved wind instrument of claim 1 wherein said footjoint section further comprises a second tone hole cup disposed to cover a low B tone hole, said second tone hole cup disposed to be normally closed by use of a spring mechanism.

8. The improved wind instrument of claim 1 wherein said footjoint section further comprises a second key affixed directly above a third tone hole cup wherein when said second key is pressed, said second key closes said third tone hole cup.

9. The improved wind instrument of claim 1 wherein said footjoint section further comprises a fourth tone hole cup wherein said fourth tone hole cup is normally open.

10. The improved wind instrument of claim 9 wherein said fourth tone hole cup is closed whenever low C is played.

11. The improved wind instrument of claim 10 wherein said fourth tone hole cup is closed when low B is played.

12. The improved wind instrument of claim 11 wherein second tone hole cup is normally closed and is opened only when low C is played.

13. The improved wind instrument of claim 8 wherein the mechanism for playing low C comprises:

a third key is pressed;

a first contact point;

a second contact point, wherein said first tone hole cup is closed and wherein when said third key is activated, said first contact point causes said third tone hole cup to close and second contact point causes said fourth tone hole cup to close, and wherein said second tone hole cup is connected to said third key and opens upon activation of said third key.

14. The improved wind instrument of claim 8 wherein the mechanism for playing low B comprises:

a fourth key attached to said fourth tone hole cup; and a third contact point; wherein said first tone hole cup is closed and wherein when a fourth key is closed, said fourth tone hole cup closes and wherein said third contact point closes said third tone hole cup and wherein said second tone hole cup remains closed;

and wherein the tone of said wind instrument is improved in the third octave for high G#, high F#, high B & high C.

15. An improved wind instrument comprising:

a body section having a cylindrical bore therethrough wherein said cylindrical bore is centered about and coincident with a longitudinal axis of said instrument and wherein said cylindrical bore is tapered along an entire length of said body section from a first end to a second end and wherein the diameter of said first end of said cylindrical bore is larger than the diameter of said second end of said cylindrical bore;

a headjoint section having a cylindrical bore therethrough wherein said cylindrical bore is centered about and coincident with the longitudinal axis of said instrument, wherein said first end of said headjoint section mates with said second end of said body section and wherein said first end of said headjoint section comprises a diameter substantially equal to said diameter of said cylindrical bore of said second end of said body section and wherein said diameter of said cylindrical bore of said headjoint section is tapered along an entire length of said headjoint section from said first end to a second end and wherein the diameter of said first end of said cylindrical bore is larger than the diameter of said second end of said cylindrical bore; and, a footjoint having a cylindrical bore therethrough wherein said cylindrical bore is centered about and coincident with the longitudinal axis of said instrument and wherein a second end of said footjoint section mates with said first end of said body section and wherein said second end of said footjoint section comprises a diameter substantially equal to said diameter of said cylindrical bore of said first end of said body section and wherein said diameter of said cylindrical bore of said footjoint section is tapered along an entire length of said footjoint section from said first end to said second end wherein said diameter of said first end of said cylindrical bore is larger than said diameter of said second end of said cylindrical bore.

16. The improved wind instrument of claim 15 wherein said footjoint section is disposed such that during normal play of said improved piccolo, a low B key is normally closed and is opened only when low C is sounded.

17. The improved wind instrument of claim 16 wherein said a footjoint section further comprises a first tone hole cup disposed to cover a D# tone hole, said first tone hole cup disposed to be normally closed by use of a spring mechanism.

18. The improved wind instrument of claim 17 wherein said first tone hole cup is further connected to a first key.

19. The improved wind instrument of claim 18 wherein a low D# may be played by pressing said first key.

20. The improved wind instrument of claim 19 wherein said first tone hole cup is closed when any note lower than low D# is played.

21. The improved wind instrument of claim 20 wherein said footjoint section is utilized to play a low C# wherein said first tone hole cup is normally closed.

22. The improved wind instrument of claim 16 wherein said footjoint section further comprises a second tone hole cup disposed to cover a low B tone hole, said second tone hole cup disposed to be normally closed by use of a spring mechanism.

23. The improved wind instrument of claim 16 wherein said footjoint section further comprises a second key affixed directly above a third tone hole cup wherein when said second key is pressed, said second key closes said third tone hole cup.

24. The improved wind instrument of claim 16 wherein said footjoint section further comprises a fourth tone hole cup wherein said fourth tone hole cup is normally open.

25. The improved wind instrument of claim 24 wherein said fourth tone hole cup is closed whenever low C is played.

26. The improved wind instrument of claim 25 wherein said fourth tone hole cup is closed when low B is played.

27. The improved wind instrument of claim 26 wherein second tone hole cup is normally closed and is opened only when low C is played.

28. The improved wind instrument of claim 23 wherein the mechanism for playing low C comprises:

a third key is pressed;

a first contact point;

a second contact point, wherein said first tone hole cup is closed and wherein when said third key is activated, said first contact point causes said third tone hole cup to close and second contact point causes said fourth tone hole cup to close, and wherein said second tone hole cup is connected to said third key and opens upon activation of said third key.

29. The improved wind instrument of claim 23 wherein the mechanism for playing low B comprises:

a fourth key attached to said fourth tone hole cup; and a third contact point; wherein said first tone hole cup is closed and wherein when a fourth key is closed, said fourth tone hole cup closes and wherein said third contact point closes said third tone hole cup and wherein said second tone hole cup remains closed;

and wherein the tone of said wind instrument is improved in the third octave for high G#, high F#, high B & high C.

30. An improved wind instrument comprising:

a body section having a cylindrical bore therethrough wherein said cylindrical bore is centered about and coincident with a longitudinal axis of said instrument and wherein said cylindrical bore is tapered along an entire length of said body section from a first end to a second end and wherein the diameter of said first end of said cylindrical bore is larger than the diameter of said second end of said cylindrical bore;

a headjoint section having a cylindrical bore therethrough wherein said cylindrical bore is centered about and coincident with the longitudinal axis of said instrument, wherein said first end of said headjoint section mates with said second end of said body section and wherein said first end of said headjoint section comprises a diameter substantially equal to said diameter of said cylindrical bore of said second end of said body section and wherein said diameter of said cylindrical bore of said headjoint section is tapered along an entire length of said headjoint section from said first end to a second end and wherein the diameter of said first end of said cylindrical bore is larger than the diameter of said second end of said cylindrical bore; and, a footjoint section having a cylindrical bore therethrough wherein said cylindrical bore is centered about and coincident with said longitudinal axis of said instrument wherein said diameter of said cylindrical bore is uniform throughout the entirety of said footjoint section and wherein said diameter is substantially equal to the diameter and wherein said body section mates with said footjoint section at an end of said body section opposing said end which mates with said headjoint section.

31. The improved wind instrument of claim 30 wherein said footjoint section is disposed such that during normal play of said improved piccolo, a low B key is normally closed and is opened only when low C is sounded.

32. The improved wind instrument of claim 31 wherein said footjoint section is disposed such that during normal play of said improved piccolo, a low B key is normally closed and is opened only when low C is sounded.

33. The improved wind instrument of claim 32 wherein said a footjoint section further comprises a first tone hole cup disposed to cover a D# tone hole, said first tone hole cup disposed to be normally closed by use of a spring mechanism.

34. The improved wind instrument of claim 33 wherein said first tone hole cup is further connected to a first key.

35. The improved wind instrument of claim 34 wherein a low D# may be played by pressing said first key.

36. The improved wind instrument of claim 35 wherein said first tone hole cup is closed when any note lower than low D# is played.

37. The improved wind instrument of claim 36 wherein said footjoint section is utilized to play a low C# wherein said first tone hole cup is normally closed.

38. The improved wind instrument of claim 32 wherein said footjoint section further comprises a second tone hole cup disposed to cover a low B tone hole, said second tone hole cup disposed to be normally closed by use of a spring mechanism.

39. The improved wind instrument of claim 32 wherein said footjoint section further comprises a second key affixed directly above a third tone hole cup wherein when said second key is pressed, said second key closes said third tone hole cup.

40. The improved wind instrument of claim 32 wherein said footjoint section further comprises a fourth tone hole cup wherein said fourth tone hole cup is normally open.

41. The improved wind instrument of claim 40 wherein said fourth tone hole cup is closed whenever low C is played.

42. The improved wind instrument of claim 41 wherein said fourth tone hole cup is closed when low B is played.

43. The improved wind instrument of claim 42 wherein second tone hole cup is normally closed and is opened only when low C is played.

44. The improved wind instrument of claim 43 wherein the mechanism for playing low C comprises:

a third key is pressed;

a first contact point;

a second contact point, wherein said first tone hole cup is closed and wherein when said third key is activated, said first contact point causes said third tone hole cup to close and second contact point causes said fourth tone hole cup to close, and wherein said second tone hole cup is connected to said third key and opens upon activation of said third key.

45. The improved wind instrument of claim 39 wherein the mechanism for playing low B comprises:

a fourth key attached to said fourth tone hole cup; and a third contact point; wherein said first tone hole cup is closed and wherein when a fourth key is closed, said fourth tone hole cup closes and wherein said third contact point closes said third tone hole cup and wherein said second tone hole cup remains closed;

and wherein the tone of said wind instrument is improved in the third octave for high G#, high F#, high B & high C.

* * * * *